United States Patent [19]

Hull

[11] Patent Number: 4,999,129

[45] Date of Patent: Mar. 12, 1991

[54] PROCESS AND COMPOSITION FOR WASHING SOILED POLYESTER FABRICS

[76] Inventor: Michael Hull, Windcliffe, Alvanley Road Helsby, Via Warrington WA6 9PS, United Kingdom

[21] Appl. No.: 319,934

[22] Filed: Mar. 6, 1989

Related U.S. Application Data

[63] Continuation of Ser. No. 74,737, Jul. 17, 1987, abandoned.

[30] Foreign Application Priority Data

Jul. 30, 1986 [GB] United Kingdom ..... 8618635

[51] Int. Cl.[5] ..... C11D 3/22; C11D 3/28; C11D 3/37

[52] U.S. Cl. ..... 252/174.17; 252/174.23; 252/524; 252/542; 252/DIG. 15; 8/137

[58] Field of Search ..... 252/DIG. 15, 174.17, 252/524, 542, 174.23

[56] References Cited

U.S. PATENT DOCUMENTS

| | | | |
|---|---|---|---|
| 3,000,830 | 9/1961 | Fong et al. | 252/117 |
| 3,318,816 | 5/1967 | Trowbridge | 252/137 |
| 3,523,088 | 8/1970 | Dean | 252/138 |
| 3,920,561 | 11/1975 | DesMarais | 252/8.8 |
| 4,006,092 | 2/1977 | Jones | 252/95 |
| 4,007,305 | 2/1977 | Kakar et al. | 427/322 |
| 4,138,352 | 2/1979 | Teot | 252/135 |
| 4,309,316 | 1/1982 | Lange et al. | 252/543 |
| 4,379,061 | 4/1983 | Rabitach et al. | 252/174 |
| 4,444,561 | 5/1984 | Denzinger et al. | 8/137 |
| 4,529,535 | 7/1985 | Sherman | 252/106 |
| 4,569,681 | 4/1986 | Ruppert et al. | 252/542 |
| 4,634,544 | 1/1987 | Weber et al. | 252/99 |

FOREIGN PATENT DOCUMENTS

| | | |
|---|---|---|
| 13585 | 7/1980 | European Pat. Off. . |
| 181205 | 5/1986 | European Pat. Off. . |
| 0203486 | 12/1986 | European Pat. Off. . |
| 213730 | 3/1987 | European Pat. Off. . |
| 1114606 | 4/1958 | Fed. Rep. of Germany . |
| 2165834 | 12/1971 | Fed. Rep. of Germany . |
| 61113696 | 11/1984 | Japan . |
| 60-084397 | 5/1985 | Japan . |
| 715149 | 8/1970 | South Africa . |
| 1079388 | 8/1967 | United Kingdom . |
| 1241754 | 4/1968 | United Kingdom . |
| 1333803 | 10/1973 | United Kingdom . |
| 1348212 | 3/1974 | United Kingdom . |
| 1354498 | 5/1974 | United Kingdom . |
| 1444863 | 5/1974 | United Kingdom . |
| 1450234 | 9/1976 | United Kingdom . |
| 1450234 | 9/1976 | United Kingdom . |
| 1493085 | 1/1977 | United Kingdom . |
| 1536136 | 12/1978 | United Kingdom . |
| 1547275 | 6/1979 | United Kingdom . |
| 2038353 | 7/1980 | United Kingdom . |
| 2132656 | 12/1983 | United Kingdom . |
| 2137221 | 3/1984 | United Kingdom . |

*Primary Examiner*—Dennis Albrecht
*Assistant Examiner*—James M. Silbermann

[57] ABSTRACT

A detergent composition comprises a detergent active material, polypyrrolidone, and a nonionic cellulose ether. The polyvinyl pyrrolidone and cellulose ether are present to reduce redeposition of suspended soil onto fabrics washed with this composition.

4 Claims, 1 Drawing Sheet

PROCESS AND COMPOSITION FOR WASHING SOILED POLYESTER FABRICS

This is a continuation application of Ser. No. 074,737, filed July 17, 1987, now abandoned.

The present invention relates to a detergent composition, in particular it relates to a detergent composition capable of providing improved soil-suspension.

It is known that the efficient washing of soiled fabrics is dependant on at least two factors, namely the removal of soil from the fabrics and soil suspension, ie. the prevention of redeposition of the suspended soil onto the fabrics.

It has previously been suggested that materials which improve soil suspension should be added to detergent compositions. In U.S. Pat. No. 3 000 830, the addition of a vinyl pyrrolidone polymer to a detergent composition to prevent re-deposition of suspended soil is disclosed. U.S. Pat. No. 3 318 816, discloses that a synergistic improvement in soil suspension can be achieved if a combination of a vinyl pyrrolidone polymer and sodium carboxymethylcellulose are added to a detergent composition.

The disadvantage with detergent compositions containing sodium carboxymethylcellulose as the soil-suspending agent is that anti-redeposition is usually limited to cellulose fibres.

Figure 1:
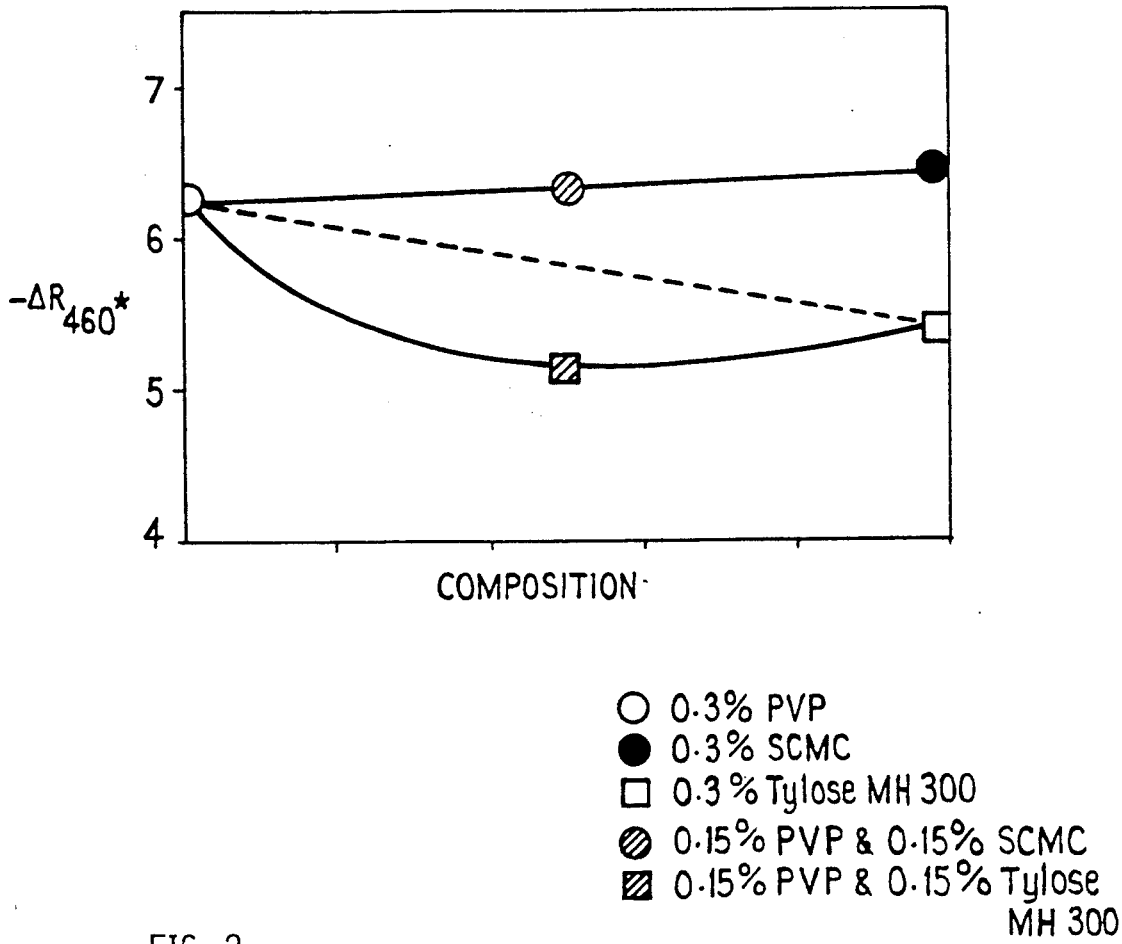
FIG. 1 shows soil anti-redeposition on polyester cloth.

We have now discovered that a surprising improvement in soil-suspension can be achieved if a mixture of a vinyl pyrrolidone polymer and a nonionic cellulose ether is added to a detergent composition.

Thus, according to the invention there is a provided a detergent composition comprising (a) a synthetic detergent active, (b) a vinyl pyrrolidone polymer, and (c) a nonionic cellulose ether As is disclosed in the art, polyvinyl pyrrolidone is not a single individual compound but may be obtained in almost any degree of polymerisation. The degree of polymerisation, which is most easily expressed in terms of average molecular weight, is not critical provided the material has the desired water solubility and soil-suspending power. In general, suitable soil-suspending vinyl pyrrolidone polymers are linear in structure, and have an average molecular weight within the range of about 5,000 to about 100,000, and preferably from about 15,000 to about 50,000. Suitable polymers will also, generally, have a water solubility of greater than 0.3% at normal wash temperatures.

Any well-known nonionic cellulose ether may be used in the detergent composition according to the invention. Preferably the cellulose ether is an alkyl or an alkyl/ hydroxyalkyl cellulose derivative. The alkyl group should contain from 1 to 4, preferably from 1 to 3 carbon atoms, and the hydroxyalkyl group should contain from 2 to 4, preferably from 2 to 3 carbon atoms. Particularly preferred materials include methyl hydroxethyl cellulose, methyl hydroxylpropyl cellulose and ethyl hydroxyethyl cellulose.

The total level of the soil-suspending agents in the detergent composition is preferably within the range from about 0.1% to about 5%, most preferably from about 0.3% to about 3%, by weight of the composition.

An improvement in soil suspension may be achieved at all mixing ratios of the vinyl pyrrolidone polymer and the nonionic cellulose ether. Preferably, the ratio of the vinyl pyrrolidone polymer to the nonionic cellulose ether in the detergent composition is within the range from about 8:2 to about 2:8, most preferably from about 6:4 to about 4:6, by weight.

The detergent composition according to the invention comprises a synthetic detergent active material otherwise referred to herein simply as a detergent compound. The detergent compound may be selected from anionic, nonionic, zwitterionic and amphoteric synthetic detergent active materials. Many suitable detergent compounds are commercially available and are fully described in the literature, for example in "Surface Active Agents and Detergents", Volumes I and II, by Schwartz, Perry and Berch.

The preferred detergent compounds which can be used are synthetic anionic and nonionic compounds. The former are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–C20 alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Suitable nonionic detergent compounds which may be used include, in particular, the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally up to 25 EO, ie up to 25 units of ethylene oxide per molecule, the condensation products of aliphatic ($C_8$–$C_{18}$) primary or secondary linear or branched alcohols with ethylene oxide, generally up to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of detergent compounds, for example, mixed anionic or mixed anionic and nonionic compounds may be used in the detergent composition according to the invention, particularly in the latter case to provide controlled low sudsing properties. This is beneficial for compositions intended for use in suds-intolerant automatic washing machines.

Amounts of amphoteric or zwitterionic detergent compounds can also be used in the composition according to the invention but this is not normally desired due to their relatively high cost. If any amphoteric or zwitterionic detergent compounds are used it is generally in small amounts in compositions based on the much more commonly used synthetic anionic and/or nonionic detergent compounds.

The detergent composition according to the invention may also contain from about 5% to about 90% of a detergency builder, which can be an inorganic builder salt, or an organic builder salt.

Examples of phosphorus-containing inorganic detergency builders, when present, include the water-soluble salts, especially alkaline metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic detergency builders, when present, include water-soluble alkali metal carbonates, bicarbonates, silicates and crystalline and amorphous alumino silicates. Specific examples include sodium carbonate (with or without calcite seeds), potassium carbonates, sodium and potassium bicarbonates and silicates.

Examples of organic detergency builders, when present, include the alkaline metal, ammonium and substituted ammonium polyacetates, carboxylates, polycarboxylates, polyacetyl carboxylates and polyhydroxysulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid.

A further class of builder salt is the insoluble aluminosilicate type.

The detergent composition according to the invention may also contain any of the conventional additives in the amounts in which such materials are normally employed in fabric washing detergent compositions. Examples of these additives include lather boosters such as alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents, fabric softening agents, inorganic salts, such as sodium sulphate, and usually present in very minor amounts fluorescent agents, perfumes, germicides and colourants.

It is also desirable to include in the detergent composition according to the invention an amount of an alkali metal silicate, particularly sodium ortho-, metaor preferably neutral or alkaline silicate. The presence of such alkali metal silicates at levels of at least about 1%, and preferably from about 3% to about 15%, by weight of the composition, is advantageous in decreasing the corrosion of metal parts in washing machines, besides giving processing benefits and generally improved powder properties. The more highly alkaline ortho- and metasilicates would normally only be used at lower amounts within this range, in admixture with the neutral or alkaline silicates.

It is generally also desirable to include a structurant material, such as succinic acid, and/or other dicarboxylic acids, sucrose and polymers, in detergent compositions of the invention, to provide a powder having excellent physical properties.

The detergent composition according to the invention can be manufactured in the form of a powder, liquid or bar.

Detergent powder compositions according to the invention can be prepared using any of the conventional manufacturing techniques commonly used or proposed for the preparation of fabric washing detergent powder compositions. These include slurry-making followed by spray-drying or spray-cooling and subsequent dry-dosing of sensitive ingredients not suitable for incorporation prior to a drying or heating step. Other conventional techniques, such as noodling, granulation, mixing by fluidisation in a fluidised bed, may be utilised as and when necessary. Such techniques are familiar to those skilled in the art of fabric washing detergent powder composition manufacture.

In use the detergent compositions according to the present invention are particularly suitable for washing synthetic fibre fabrics.

The invention is further illustrated by the following nonlimiting examples.

EXAMPLES

Four pieces of desized cotton interlock and four pieces of desized bulked polyester, each measuring 7.5cm × 7.5cm, were washed together with one piece each (7.5cm × 7.5cm) of three different soiled cloths. This washing process was repeated six times with the same cotton and polyester cloths but with freshly soiled cloths. These experiments were carried out in a laboratory apparatus in a litre of water at 40° C. containing 3g of a detergent composition; the duration of the wash cycle was 30 minutes. The detergent composition contained 6% of a linear alkylbenzene sulphonate with approximately 12 carbon atoms (Petrelab 550), 6% alkoxylated alcohol (Synperonic A7), 6% alkaline silicate, 30% sodium tripolyphosphate, 13.6% sodium sulphate and varying amounts of polyvinyl pyrrolidone (Sokalan HP50[1] (ex BASF)) and a nonionic cellulose ether (Tylose MH300[2]) as disclosed in the examples below. Treatment baths containing this detergent composition were prepared by dissolving the polyvinyl pyrrolidone and the cellulose ether into a wash liquor which contained the other components.

[1]Sokalan HP50 is polyvinyl pyrrolidone with an average molecular weight of 40,000.

[2]Tylose MH300 is a methyl hydroxyethyl cellulose.

After washing, the cloths were rinsed in one litre of 24° FH. water and then tumble dried. Using a "ICS" micromatch reflectance spectrophotometer, fitted with a UV filter, the reflectance of the treated test cloths at 460nm was determined. For comparison purposes reflectance values at 460nm were measured for untreated polyester and cotton cloths. The value of $\Delta R^*$ is the difference in reflectance between the washed and untreated cloths.

EXAMPLE 1

The following results show the variation in the value of $\Delta R_{460}$* determined for polyester cloth washed in the detergent composition which contained a total amount of 1% by weight of a mixture of Sokalan HP50 and Tylose MH300.

The values of $\Delta R_{460}$* are relative to the value of $\Delta R_{460}$* for a composition containing 100% Tylose MH300, and 0% Sokalan HP50, which is taken to be 0.

| % by weight Sokalan HP50 | % by weight Tylose MH300 | $\Delta R_{460}$* |
|---|---|---|
| 0 | 100 | 0 |
| 10 | 90 | 0.85 |
| 25 | 75 | 1.16 |
| 40 | 60 | 1.58 |
| 50 | 50 | 1.37 |
| 60 | 40 | 1.62 |
| 75 | 25 | 1.14 |
| 90 | 10 | −0.2 |
| 100 | 0 | −0.1 |

It is apparent from the above data that a surprising improvement in soil-suspension is achieved using a detergent composition containing a mixture of Tylose MH300 and Sokalan HP50. In particular, improved soil-suspension is achieved with 0.4–0.6 by weight fraction of Sokalan HP50.

EXAMPLE 2

This example compares the soil redeposition for polyester and cotton cloths washed in detergent compositions which contained one of the following:

(i) 0.3% Sokalan HP50;
(ii) 0.3% Tylose MH300;
(iii) 0.3% sodium carboxymethylcellulose (SCMC);
(iv) 0.15% Sokalan HP50 and 0.15% Tylose MH300 or (v) 0.15% Sokalan HP50 and 0.15% SCMC.

Figure 2:
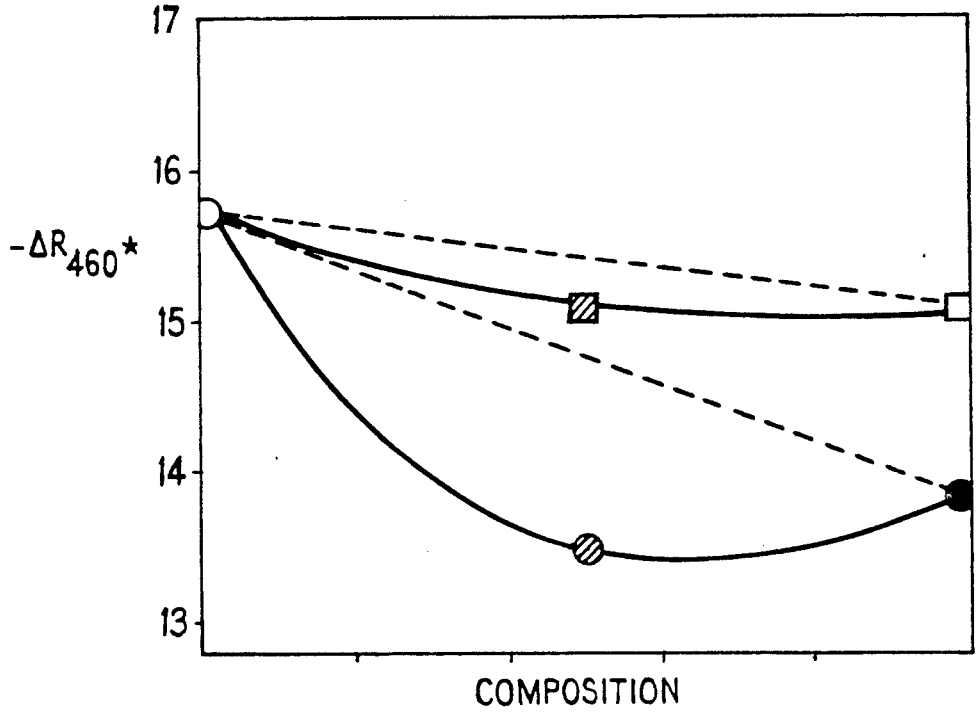
FIG. 2 shows soil anti-redeposition on cotton cloth.

After six washes values of $\Delta R_{460}$* were measured for each of the cloths and the results obtained for the polyester and cotton cloths are shown in FIGS. 1 and 2 respectively.

The results in FIG. 1 show that a mixture of SCMC and Sokalan HP50 does not give an improvement in soil anti-redeposition on polyester cloth, whereas a mixture of Tylose MH300 and Sokalan HP50 shows such an improvement. However, as shown by FIG. 2, on cotton cloth there is a improvement in anti-redeposition for a mixture of SCMC and Sokalan HP50; this improvement is only small for a mixture of Tylose MH300 and Sokalan HP50.

EXAMPLE 3

This example compares the anti-redeposition effects on polyester cloths of mixtures containing Tylose MH300 and polyvinyl pyrrolidone (PVP) with a molecular weight of 40,000 or 10,000. Values of $\Delta R_{460}$* were measured and the following results were obtained. ($\Delta R$ expected is the average value of $-\Delta R_{460}$* obtained when the cloths are washed in a detergent composition containing, (i) 1% PVP; and
(ii) 1% Tylose MH300).

| % by weight PVP (M. Wt 40,000) | % by weight Tylose MH300 | $-\Delta R_{460}$* | ΔR expected / ΔR found |
|---|---|---|---|
| 1.0 | — | 5.54 | |
| — | 1.0 | 5.64 | |
| 0.5 | 0.5 | 4.27 | 1.31 |
| % by weight PVP (M. Wt 10,000) | % by weight Tylose MH300 | $-\Delta R_{460}$* | ΔR expected / ΔR found |
| 1.0 | — | 6.01 | |
| — | 1.0 | 5.64 | |
| 0.5 | 0.5 | 5.42 | 1.07 |

Clearly the lower molecular weight vinyl pyrrolidone polymer is not as effective as the 40,000 molecular weight material.

EXAMPLE 4

This example demonstrates that nonionic cellulose ethers other than Tylose MH300 give a surprising improvement in anti-redeposition when they are mixed with Sokalan HP50. Polyester cloths were washed in detergent compositions which contained 0.5% Sokalan HP50 and 0.5% of F4M[3], Bermocoll CST 035[4]. Values of $\Delta R_{460}$* were measured and the following results obtained.

| Cellulose ether | $\Delta R_{460}$* | ΔR expected / ΔR found |
|---|---|---|
| Tylose MH300 | 4.27 | 1.31 |
| Bermocoll CST 035 | 4.08 | 1.30 |
| Methocel F4M | 4.54 | 1.13 |

3 Methocel F4M is a methyl hydroxypropyl cellulose
4 Bermocoll CST 035 is an ethyl hydroxyethyl cellulose

EXAMPLE 5

This example compares the anti-redeposition effects on polyester cloths of mixtures containing methyl hydroxyethyl cellulose (Tylose MH300) and polyvinyl pyrrolidone (Sokalan HP50) with those in which the polyvinyl pyrrolidone is replaced by polyvinyl alcohol (Elvanol 51.05 (ex DuPont)). It repeats Example 3 described above except that different soiled cloths were used. Values of $\Delta R_{460}$* were measured after 3 and 6 washes and the following results obtained. ($\Delta R$ expected is the average value of $-\Delta R_{460}$* obtained when the cloths are washed in a detergent composition containing (i) 1% Sokalan HP50 or 1% Elvanol 51.05 (as appropriate) and
(ii) 1% Tylose MH300.)

| 3 WASH REDEPOSITION | | | |
|---|---|---|---|
| % by weight PVP Sokalan HP50 | % by weight Tylose MH300 | $-\Delta R_{460}$* | ΔR expected / ΔR found |
| 1.0 | — | 2.4 | |
| — | 1.0 | 2.3 | |
| 0.5 | 0.5 | 1.0 | 2.4 |
| % by weight PVA (Elvanol 51.05)[5] | % by weight Tylose MH300 | $-\Delta R_{460}$* | ΔR expected / ΔR found |
| 1.0 | — | 2.7 | |
| — | 1.0 | 2.6 | |
| 0.5 | 0.5 | 1.9 | 1.4 |
| 6 WASH REDEPOSITION | | | |
| % by weight PVP (mol. wt. 40,000) | % by weight Tylose MH300 | $-\Delta R_{460}$* | ΔR expected / ΔR found |
| 1.0 | — | 3.6 | |

-continued

| | | | |
|---|---|---|---|
| — | 1.0 | 3.3 | |
| 0.5 | 0.5 | 1.3 | 2.6 |

| % by weight PVA (Elvanol 51.05) | % by weight Tylose MH300 | $-\Delta R_{460}$* | ΔR expected / ΔR found |
|---|---|---|---|
| 1.0 | — | 3.3 | |
| — | 1.0 | 2.8 | |
| 0.5 | 0.5 | 2.5 | 1.2 |

The results demonstrate that a mixture of a methyl hydroxyethyl cellulose and polyvinyl alcohol is not as effective as a mixture of methyl hydroxyethyl cellulose and polyvinyl pyrrolidone in controlling redeposition of suspended soil onto polyester cloths 5 Elvanol 51.05 is a low molecular weight highly water soluble polyvinyl alcohol As used herein, "° FH" with respect to water hardness is the molar concentration of hard water ions $\times 10^4$.

We claim:

1. A process for removing soil from a polyester fabric and reducing the redeposition of removed soil comprising washing said fabrics in a detergent composition comprising (a) from 5% to 90% by weight of a synthetic detergent active;

(b) a vinyl pyrrolidone polymer having a molecular weight of from 15,000 to 50,000; and (c) a nonionic cellulose ether selected from the group consisting of alkyl and alkyl/hydroxyalkyl cellulose derivatives wherein the alkyl group has from 1 to 4 carbon atoms and the hydroxyalkyl group has from 2 to 4 carbon atoms, and wherein the ratio of the vinyl pyrrolidone polymer to the nonionic cellulose ether is within the range 8:2 to 2:8 and the total level of the vinyl pyrrolidone polymer and the nonionic cellulose ether is within the range from 0.1% to 5% by weight.

2. A process according to claim 1 wherein the ratio of the vinyl pyrrolidone polymer to the nonionic cellulose either is within the range from 6.4 to 4.6.

3. A process according to claim 1 wherein the nonionic cellulose ether is selected from the group consisting of (i) methyl hydroxyethyl cellulose;

(ii) methyl hydroxypropyl cellulose; and (iii) ethyl hydroxyethyl cellulose.

4. A process for removing soil from a polyester fabric and reducing the redeposition of removed soil comprising washing said fabrics in a detergent composition comprising:

(a) from 5% to 90% by weight of a synthetic detergent active;

(b) a vinyl pyrrolidone polymer having a molecular weight of 40,000; and (c) a nonionic cellulose ether selected from the group consisting of alkyl and alkyl/hydroxyalkyl cellulose derivatives wherein the alkyl group has from 1 to 4 carbon atoms and the hydroxyalkyl group has from 2 to 4 carbon atoms, and wherein the ratio of vinyl pyrrolidone polymer to the nonionic cellulose ether is in the ratio of 1:1 and the total level of the vinyl pyrrolidone polymer and the nonionic cellulose ether is within the range from 0.1% to 5% by weight.

* * * * *